US006116556A

United States Patent [19]

Roth

[11] Patent Number: 6,116,556

[45] Date of Patent: Sep. 12, 2000

[54] MULTI-MOUNT FOR LIGHTING AND POLE ACCESSORIES

[75] Inventor: Peter L. Roth, Dallas, Tex.

[73] Assignee: C. E. W. Lighting, Inc., Dallas, Tex.

[21] Appl. No.: 09/245,793

[22] Filed: Feb. 5, 1999

[51] Int. Cl.[7] ..... A47B 96/06

[52] U.S. Cl. ..... 248/218.4; 248/200.1; 248/219.2; 362/431

[58] Field of Search ..... 248/200, 218.4, 248/219.2, 201.1; 362/431, 432, 369; 40/607, 605, 606, 729

[56] References Cited

U.S. PATENT DOCUMENTS

| | | | |
|---|---|---|---|
| 1,344,268 | 6/1920 | Gayle | 40/607 |
| 2,539,546 | 1/1951 | McGuire | 40/145 |
| 3,696,242 | 10/1972 | Patry | 240/84 |
| 3,794,826 | 2/1974 | Jablonski . | |
| 4,064,432 | 12/1977 | Compton et al. . | |
| 4,349,865 | 9/1982 | Terrel . | |
| 4,380,792 | 4/1983 | Terrell . | |
| 4,449,169 | 5/1984 | Warshawsky | 362/413 |
| 4,459,649 | 7/1984 | Shaneour . | |
| 4,577,449 | 3/1986 | Celli | 52/721 |
| 4,822,077 | 4/1989 | Hendrickson . | |
| 4,846,499 | 7/1989 | Izumi et al. | 280/830 |
| 4,967,800 | 11/1990 | Heilmayr et al. . | |
| 5,174,535 | 12/1992 | Stubbersfield | 248/316.1 |
| 5,260,860 | 11/1993 | Jordan et al. . | |
| 5,335,471 | 8/1994 | Kupiec | 52/727 |
| 5,426,577 | 6/1995 | Gordin et al. | 362/431 |
| 5,664,748 | 9/1997 | Speece et al. | 248/219.2 |
| 5,699,989 | 12/1997 | Guthrie | 248/219.2 |
| 5,709,057 | 1/1998 | Johnson, Jr. et al. | 52/301 |
| 5,906,064 | 5/1999 | Field | 40/606 |

*Primary Examiner*—Ramon O. Ramirez
*Assistant Examiner*—Tan Le
*Attorney, Agent, or Firm*—Thomas W. Cook

[57] ABSTRACT

A "twin-mount" pole mounting assembly for use with a pole mounting "bracket" is disclosed, useful to hold or support lighting, security equipment (such as cameras and microphones), safety mirrors, electrical transmission lines and insulators, and the like accessories, the mounting assembly consisting of a mounting sleeve having a plurality of tubular sections, arranged so that a user may mount the bracket on poles of either circular or square cross-section, or on a tenon of circular or square cross-section affixed to such poles.

14 Claims, 8 Drawing Sheets

MULTI-MOUNT FOR LIGHTING AND POLE ACCESSORIES

TECHNICAL FIELD OF THE INVENTION

The present invention relates to a pole mounting assembly. More particularly, the present invention relates to a new assembly upon which a user may mount lighting, pole accessories, or other accessories upon a pole tenon of circular cross section, or on a pole having a square cross section, and thereby use poles and tenons of either circular or square cross section to mount lighting or accessories above parking lots or roadways, on buildings, and in other places where lighting or such accessories are desirable.

BACKGROUND ART OF THE INVENTION

The use of mounts and mounting assemblies of various designs and configurations to affix lighting and other accessories to poles is known in the prior art. Such designs include:

U.S. Pat. No. 3,794,826 to Jablonski, which discloses an arrangement for holding a pole-top light to the open end of a hollow support pole.

U.S. Pat. No. 4,064,432 to Compton et al., which discloses a tenon for mounting a lighting fixture to a support.

U.S. Pat. No. 4,349,865 to Terrel, which discloses an adjustable lamp mounting assembly for two lamps.

U.S. Pat. No. 4,380,792 to Terrell, which discloses a pivot mounting for a lamp.

U.S. Pat. No. 4,459,649 to Shaneour, which discloses a pole mounted lighting supporting frame system.

U.S. Pat. No. 5,260,860 to Jordan et al., which discloses an expanding tenon clamp for securing a lighting fixture to a mounting apparatus and pole.

A number of other patents relate to various connecting inventions designed to securely connect and hold pipes of differing diameters, such as that found in U.S. Pat. No. 4,822,077 to Hendrickson, which discloses a pipe coupling, and inventions designed to securely connect and hold one portion of pipe to another, and such as that found in U.S. Pat. No. 4,967,800 to Heilmayr et al., which discloses a secondary confinement pipe assembled from identical pipe segments.

While the devices disclosed in these prior patents fulfill their respective objectives, these prior patents do not describe or suggest a "twin-mount" or "multi-mount" assembly for mounting lights or other accessories to poles or tenons of either square or circular cross section, resulting in a single mount capable of attaching such lighting or accessories to either type of support at the user's discretion. In this respect, the multi-mount assembly of the present invention substantially departs from pre-existing designs of the prior art, and in so doing provides the user with the highly desirable ability to mount to a variety of poles, with varying cross sectional shapes. The mount of the present invention thereby provides the user with the flexibility to mount, with a single assembly, to the pole or tenon the user may have on hand. The user thereby avoids the necessity of replacing the pole, at great time and expense, and allows the user a wider choice in poles or tenons, without regard to cross sectional shape, so long as the width of the mount chosen matches approximately the size of the desired (or available) pole or tenon.

The ability to mount to poles or tenons of either circular or square cross-sectional shape is accomplished through a multi-piece mount assembly, composed of one length of generally cylindrical pipe, having generally circular cross section, positioned within another piece of pipe of approximately equal length, having generally square cross section. The finished mounting assembly is thereby constructed in such fashion as to allow the user to slip the mounting assembly over or around a corresponding pipe or tenon of generally circular cross section, or slip the mounting assembly into or within a corresponding pole of generally square cross section at the discretion of the user. The ability to thereby use a single mounting assembly on poles and tenons of either cross-sectional shape without purchase of a second mount matching the characteristics of the user's existing pole or tenon (or replacing the existing pole altogether) results in substantial savings in user time, and in many cases the avoidance altogether of the time and expense required to replace the mount or the mounting pole, while avoiding purchase of a separate tenon. Therefore, it can be appreciated a need exists for a new multi-mount design which allows just such a dual-use mounting assembly.

DISCLOSURE OF INVENTION

Summary of the Invention

The present invention provides a new pole mounting assembly for use with a pole mounting "bracket." Pole mounting brackets are typically utilized to hold lighting, security equipment (such as cameras and microphones), safety mirrors, electrical transmission lines and insulators, and the like, to a pole. Such "accessories" may be mounted at the top of the pole or along its length, at the desired height or position, to meet the requirements of the user. Existing mounting brackets allow the mounting of a number of lights, so as to illuminate in many directions, or allow the mounting of combinations of the "accessories" mentioned herein.

Typical mounting brackets are comprised of a main body, or base, a pole engaging "mounting sleeve," which is attached to and extends from the base at approximately its mid-point, and one or more accessory mounting extensions, to which individual accessories are mounted. The accessory mounting extensions may be movably mounted to the base of the bracket or immovably fastened to the base by welding, however the mounting sleeve must generally by welded to the base of the mounting bracket. The free end of the mounting sleeve may be slipped over or within a mounting pole in such fashion as to place the bracket in its desired position. The arrangement most often employed is to slip a mounting sleeve having square cross section into a pole having square cross section. The width of the mounting sleeve is chosen to fit within the pole while leaving insufficient room for the mounting sleeve to turn within the pole. The mounting sleeve and pole are usually then fastened together by inserting a bolt or bolts into both mounting sleeve and pole such that the bolt passes through a wall of both the mounting sleeve and the pole.

Similarly, individual accessories generally have sleeve-like mounting portions which may be slipped over or within each accessory mounting extension of the mounting bracket in such fashion as to place the accessories in their desired positions.

The wiring utilized to connect the lights or other accessories to a power source may be fed from the mounting pole, through the mounting sleeve, and into the base of the bracket, generally through a hole formed in the base within the area circumscribed on the base within the mounting sleeve. The wiring is then fed through the base, to and through the proper accessory mounting extensions, and into the selected accessories, to electrically connect the lights and accessories to the power source. After engagement, the user may, by insertion of a set screw, bolt, or pin, or by welding or other means common in the industry, fasten the mounting sleeve to the pole, and also fasten the accessory mounting portion of each accessory to the corresponding mounting extension of the bracket.

Typical high-quality pole mounting brackets allow adjustment of accessories, whether lighting or otherwise, either vertically or horizontally, or both vertically and horizontally. Such adjustment is accomplished by fitting extensions between the accessory mounting extension and the accessory, by rotating the mounting bracket or, in some cases, by repositioning accessory mounting extensions along the length of the mountain bracket.

The new pole mounting assembly of the present invention comprises a multi-part bracket mounting sleeve which is attached to and extends from the base of the bracket. In one preferred embodiment of the present invention, the mounting sleeve is composed of two parts, each part composed of metal, preferably steel or aluminum. The entire mounting bracket assembly is generally coated, after the two parts of the mounting sleeve are welded to the base, with paint, polyester topcoat, or other weather resistant covering. However, the mounting bracket and all its parts may be formed of wood, fiberglass, and the like, where such materials are capable of withstanding the mechanical stresses applied to the attached accessories by natural forces, and the natural tendency of materials to weaken under weathering.

The first part of the mounting sleeve is a tube approximately circular in cross section (i.e., approximately cylindrical in shape). The end of the first part of the mounting sleeve is fastened, as noted above, by welding or other means of attachment, at a point about half way along the base of the mounting bracket.

The second part of the mounting sleeve is approximately square in cross section, and therefore forms a square tube (generally with rounded corners as the metal is bent during fabrication). The end of the second part of the mounting sleeve is fastened, as with the first part, by welding or other means of attachment, at a point about half way along the base of the mounting bracket. However, before the second part of the mounting sleeve is fastened into position against the base of the mounting bracket, the second part of the mounting sleeve is fitted over, and placed in position around, the first part of the mounting sleeve.

As a result of the above fabrication, a two-part mounting sleeve assembly is formed, in which a cylindrical first part resides within a square (in cross section) second part. The two parts of the sleeve are approximately equal in length and, when formed of metal, may also be welded to each other to enhance the strength of the mounting assembly, and increase overall rigidity.

The mounting sleeve assembly is provided with means for securing it to a mounting pole or tenon once the assembly is placed in position. In one embodiment of the present invention, the securing means consists of two threaded holes tapped into the walls of the second part of the mounting sleeve, in line, at opposite sides of the sleeve. Two additional holes, larger in diameter, are merely drilled, without tapping, into the walls of the first part of the mounting sleeve, and in line with the tapped holes in the second part of the mounting sleeve. The placement of all holes is such that the threaded holes and the drilled holes create a set of holes aligned to allow the passage of a screw, bolt, or pin through both the first and second parts of the mounting sleeve. At least one additional hole, but alternatively two additional holes, are then drilled in a mounting pole, or in a tenon which may be fitted on a mounting pole. To mount the bracket, a single screw or threaded bolt may be screwed through the threaded holes in the mounting sleeve, such that the screw or bolt may extend through the remaining holes in the sleeve assembly and the mounting pole or tenon. The end of the screw or threaded bolt may be locked into place by a nut tightened onto to its threaded end extending from the side of the pole, tenon, or mounting sleeve assembly.

In a second embodiment of the present invention, the securing means consists of one or more threaded holes tapped into the walls of the second part of the mounting sleeve at any point in the sides of the sleeve. One or more additional holes, larger in diameter, are merely drilled, without tapping, into the walls of the first part of the mounting sleeve, and in line with the tapped holes in the second part of the mounting sleeve. One or more holes are then drilled in the mounting pole, or in a tenon fitted to the mounting pole. To mount the bracket, one or more screws or threaded bolts are screwed through the threaded holes in the second part of the mounting sleeve, such that they may extend through the remaining holes in the first part of the mounting sleeve and the mounting pole or tenon.

The first part of the mounting sleeve in diameter sized to be conveniently passed over a cylindrical pole or tenon of standard size. To mount the bracket on a cylindrical mounting pole or tenon, therefore, the mounting sleeve may be aligned with the end of the mounting pole or tenon, and slid over the pole or tenon until the pole or tenon abuts the base of the mounting bracket inside the mounting sleeve, or until the holes of the mounting sleeve are aligned with the holes drilled in the mounting pole or tenon. At this point the mounting bracket may come to rest on the end of the pole or tenon.

The second part of the mounting sleeve is in width sized to be conveniently placed within a generally square pole of standard size. To mount the bracket on to a generally square mounting pole, therefore, the mounting sleeve may be aligned with the end of the mounting pole, and slid within the pole until the pole abuts the base of the mounting bracket outside the mounting sleeve, or until the holes of the mounting sleeve are aligned with the holes drilled in the mounting pole. At this point the mounting bracket may come to rest on the end of the pole.

By varying the diameter of the first part of the mounting sleeve during fabrication, or by varying the width of the second part of the mounting sleeve during fabrication, a variety of mounting sleeve assembly configurations may be achieved to match a variety of pole sizes. With each pole or tenon of standard size, the first and second parts of the mounting sleeve assembly are sized to fit closely enough to the pole or tenon to provide a reasonably tight and stable engagement of the mounting sleeve and the pole or tenon, the mounting sleeve fitting outside a cylindrical pole or tenon, or inside a square pole, when mounting is complete. However, whether the mounting pole or tenon is cylindrical or square, a shim or other spacer may be inserted between the mounting sleeve and mounting pole or tenon, if desired, to take up excess space, and thereby reduce movement of the bracket on the pole or tenon after mounting.

Reinforcement members may be welded or otherwise formed between the first part and the second part of the mounting sleeve, if desired, to enhance rigidity of the mounting sleeve assembly. In one preferred embodiment of the present invention, the mounting sleeve may employ one or more reinforcement members, in accordance with other features of the invention, to add support between the first part of the mounting sleeve and the second part of the mounting sleeve. The support may be as simple as one or more welds, or spot welds, between the outside of the cylindrical first part of the mounting sleeve and the inside faces of the square second part of the mounting sleeve. In alternative embodiments, separate reinforcement members may be placed so as to bridge the gap between the outside of the cylindrical first part of the mounting sleeve and the inside corners of the square second part of the mounting sleeve. If the mounting sleeve assembly is configured with reinforcement members, the thickness of the cylindrical and square sections of the first and second parts of the mounting sleeve assembly may be reduced without significantly reducing the strength of the sleeve assembly over mounts of more typical design. Moreover, the presence of reinforcement members between the first and second parts of the mounting sleeve, and the presence of the two parts of the sleeve, may each increase the area available to accept welds or other fastening between mounting sleeve and bracket base, thus increasing rigidity between the bracket and the pole, and the ability of the bracket to support larger lights and other accessories.

It may appreciated that the cylindrical first part of the mounting sleeve and the square second part of the mounting sleeve may be reversed in some applications. Accordingly, the square second part of the sleeve assembly may be attached to the base of the mounting bracket inside the cylindrical first part of the sleeve assembly, rather than outside as set forth above. Moreover, it may be appreciated that additional cylindrical parts may be attached inside the initial cylindrical part of the mounting sleeve, or additional square parts may be attached outside the initial square part or the mounting sleeve, or the mounting sleeve assembly may be fabricated with either first or second parts having other than circular or square cross-sectional shapes, thereby creating a mounting sleeve assembly which could fit poles of a variety of sizes and cross-sectional shapes.

As noted above, the mounting sleeve assembly of the present invention is formed with some means for securing it to the pole or tenon once the assembly is placed in position. This may consist of a set of holes aligned to allow the passage of a screw, bolt, or pin through both the first part and the second part of the mounting sleeve, allowing insertion into a similar hole in the pole or tenon. In one preferred embodiment, the fastening means would allow the screw, bolt, or pin to travel through the pole or tenon entirely, and screw into a threaded hole on the side of the mounting sleeve assembly away from the point of entry of the screw, bolt, or pin. However, the mounting sleeve assembly may use a variety of other means common in the industry for securing the bracket to the pole. The user of the tenon assembly of the present invention may chose that means of fastening most appropriate to the application at hand.

The more important features of the invention have thus been outlined, rather broadly, so that the detailed description thereof that follows may be better understood, and in order that the present contribution to the art may be better appreciated. Additional features of specific embodiments of the invention will be described below.

However, before explaining preferred embodiments of the invention in detail, it may be noted briefly that the mounting sleeve of the present invention provides the opportunity to purchase a single bracket capable of fastening to a variety of pole sizes and shapes, or fastening to a tenon fitted to the mounting pole. This is accomplished through the simple expedient of mounting one part of the overall mounting sleeve assembly within another part of the mounting sleeve assembly. The mounting sleeve assembly of the present invention thereby allows a user to fit a mounting bracket bearing this assembly to an available pole of standard pole size, or fit a mounting bracket to a tenon or extender or converter of either circular or square cross section. These are options not hitherto available to users. At the same time the mounting sleeve assembly of the present invention allows manufactures and distributors to exploit the flexibility of mounting brackets using this multi-part mounting sleeve design, thereby making and carrying a lesser stock of more widely usable brackets. It may be appreciated that the disclosure of the present invention specifically addresses use with poles of circular or square cross section. However, it may also be appreciated that the present invention may be adapted to poles of triangular, hexagonal, or other shape, or for use with tenons of such shape.

Objects of the Invention

The principal object of the present invention is to provide a new mounting assembly for use with lighting and accessory mounts and brackets, upon which a user may mount lighting or other accessories upon a pole of either circular or square cross section, with or without a tenon, thereby using a pole of either type to mount such lighting or accessories.

A further object of the present invention is to provide a mounting assembly of a design which has greater strength at the point of attachment of the mounting sleeve to the main body of the mounting bracket, thereby increasing the ability of the bracket to support larger lights and other accessories.

A further object of the present invention is to provide a mounting assembly which may be used with a variety of pole shapes and sizes, so that a user may apply a single bracket to more than one size or shape of pole or tenon.

A further object of the present invention is to provide a mounting assembly which allows manufactures and distributors to exploit the flexibility of mounting brackets using a multi-part tenon design to make and carrying a lesser stock of more widely usable brackets.

A further object of the present invention is to provide a mounting assembly which allows the use of the same bolts or screws when mounting to either a cylindrical pole or tenon, or to a square pole.

BRIEF DESCRIPTION OF DRAWINGS

The invention will be better understood and objects other than those set forth above will become apparent when consideration is given to the following detailed description thereof. Such description makes reference to the annexed drawings wherein:

FIG. 13 is a bottom view of the central portion of the pole mounting bracket of FIG. 1, showing the mounting sleeve assembly in close-up, with four mounting screws.

DESCRIPTION OF A FIRST PREFERRED EMBODIMENT

Figure 1:
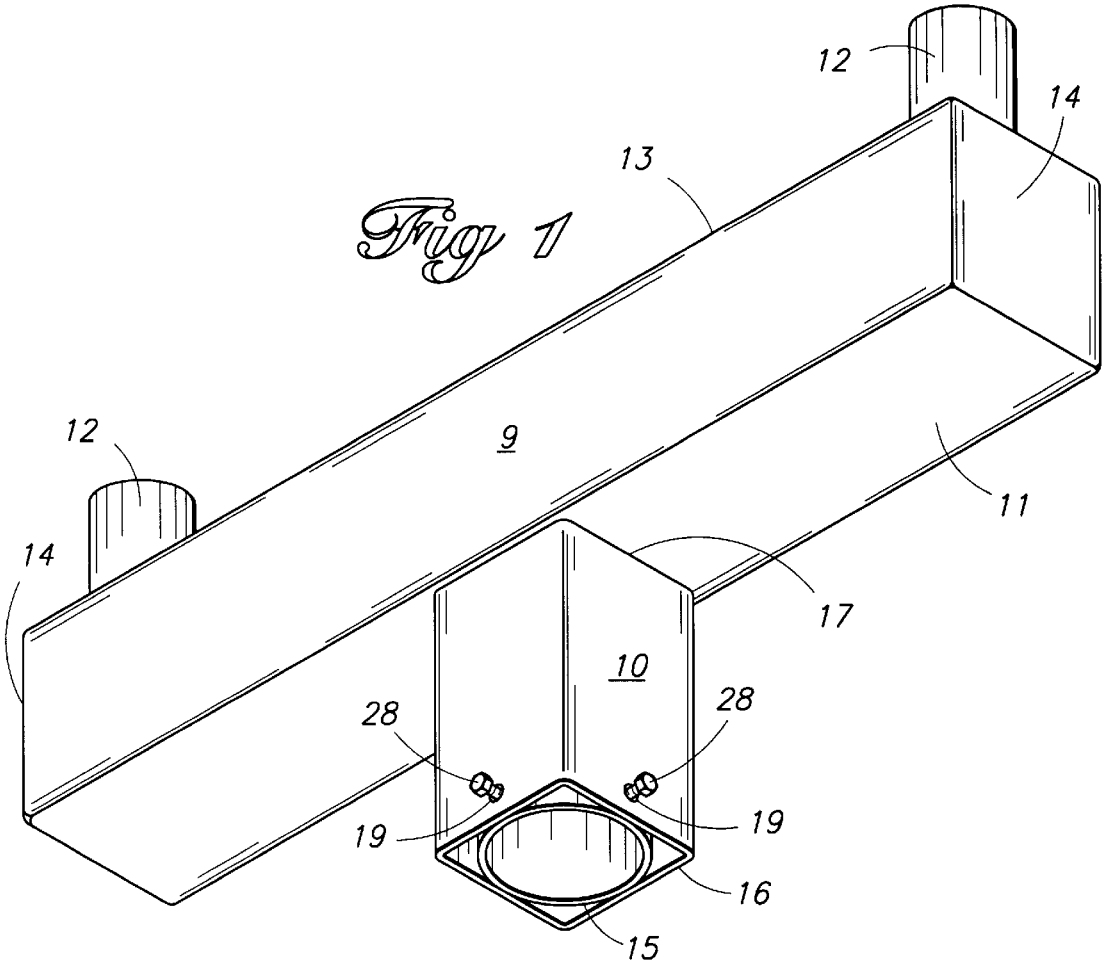
FIG. 1 is a bottom-side perspective view of a first preferred embodiment of the pole mounting sleeve assembly constructed in accordance with the principles of the present invention affixed to a pole mounting bracket of standard design.
Figure 2:
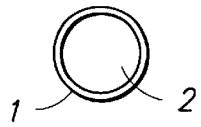
FIG. 2 is an end-on view of a cylindrical mounting pole.

Referring initially to FIG. 1, the multi-part pole mounting sleeve assembly 10 constructed in accordance with the principles of the present invention is shown affixed to the bottom-facing side 11 of the base 9 of a pole mounting bracket of otherwise standard design. The bracket of this preferred embodiment is intended to support two lights or other accessories (not shown), and so has two accessory mounting extensions 12 affixed to the top-facing side of the distal ends 14 of the bracket. The mounting sleeve assembly 10 is constructed of a tubular first part 15, approximately circular in cross section, set within a tube second part 16, approximately square in cross section. Both the tube first part 15 and the tube second part 16 are securely affixed to the bottom-facing side 11 of the base 9 of the mounting bracket by welding at their point of intersection 17. The mounting sleeve assembly 10 is shown in this embodiment with two optional fastening bolts 18 projecting from their points of entry 19 to a set of holes tapped through the second part 16 of the sleeve assembly 10, and simply drilled through the first part 15 of the sleeve assembly 10. The holes are tapped and drilled in a line to allow the bolts 18 to travel through each part of the mounting sleeve assembly 10, and though the wall of a pole upon which the bracket 9 may be set.

Figure 4:
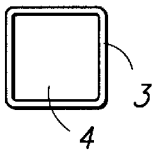
FIG. 4 is an end-on view of a mounting pole of square cross section.
Figure 6:
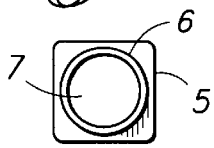
FIG. 6 is an end-on view of a mounting pole of square cross section, to the end of which is affixed a tenon mount having circular cross section above the pole.
Figure 3:
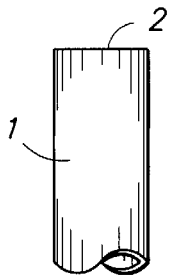
FIG. 3 is a side view of the mounting pole of FIG. 2.
Figure 5:
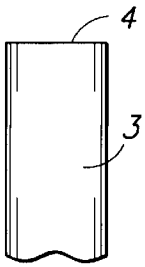
FIG. 5 is a side view of the mounting pole of FIG. 4.
Figure 7:
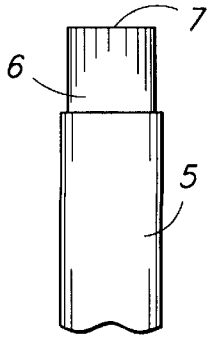
FIG. 7 is a side view of the mounting pole and tenon mount of FIG. 6.

FIGS. 2 through 7 show mounting poles of various shapes and sizes. Specifically, in FIGS. 2 and 3 a pole of circular cross-section 1 10 is shown, both from its end, in FIG. 2, and from its side, in FIG. 3, with interior 2. In FIGS. 4 and 5 a pole of square cross-section 3 is shown, both from its end, in FIG. 4, and from its side, in FIG. 5, with interior 4. In FIGS. 6 and 7 a pole of square cross-section is shown with a tenon 6 mounted to its end, both from the end of the pole, in FIG. 6, and from the side of the pole, in FIG. 7. The top portion of the tenon has cylindrical interior 7.

Figure 8:
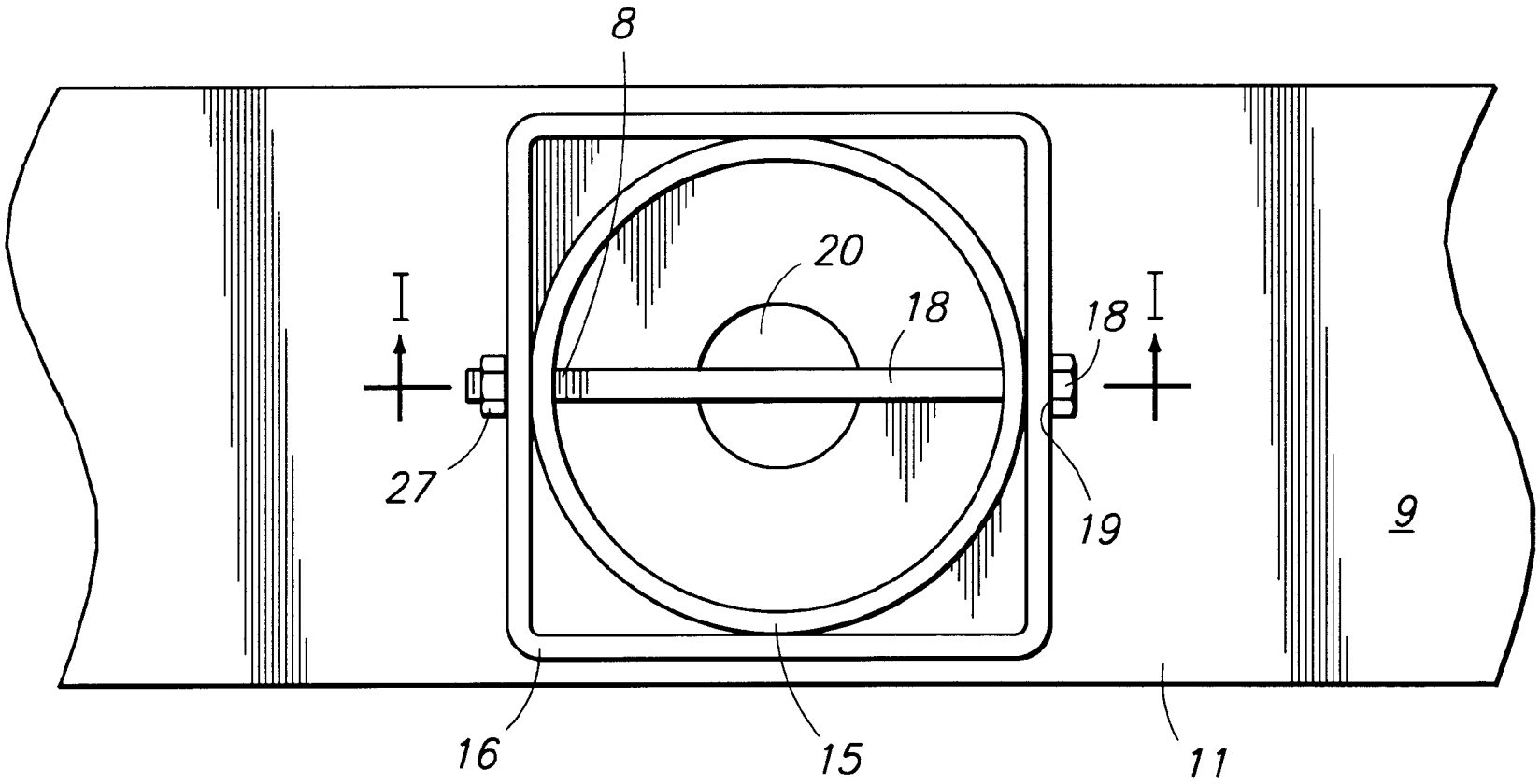
FIG. 8 is a bottom view of the central portion of the pole mounting bracket of FIG. 1, showing the mounting sleeve assembly in close-up, with mounting bolt.

In FIG. 8, the multi-part mounting sleeve assembly 10 is further shown on the bottom-facing side 11 of the center portion of the mounting bracket 9. In this embodiment, an optional bolt 18 has been inserted through the second part 16 of the sleeve assembly 10 and the first part 15 of the sleeve assembly 10. The bolt 18 has threads 8 which engage the threads tapped into the second part 16 of the sleeve assembly 10. A nut 27 may be screwed onto the bolt 18 to secure it in place. A hole 20, through which wires may be passed for electrical connection, is also drilled into the bottom-facing side 11 of the bracket 9 at a convenient location within the first part 15 of the sleeve.

Figure 9:
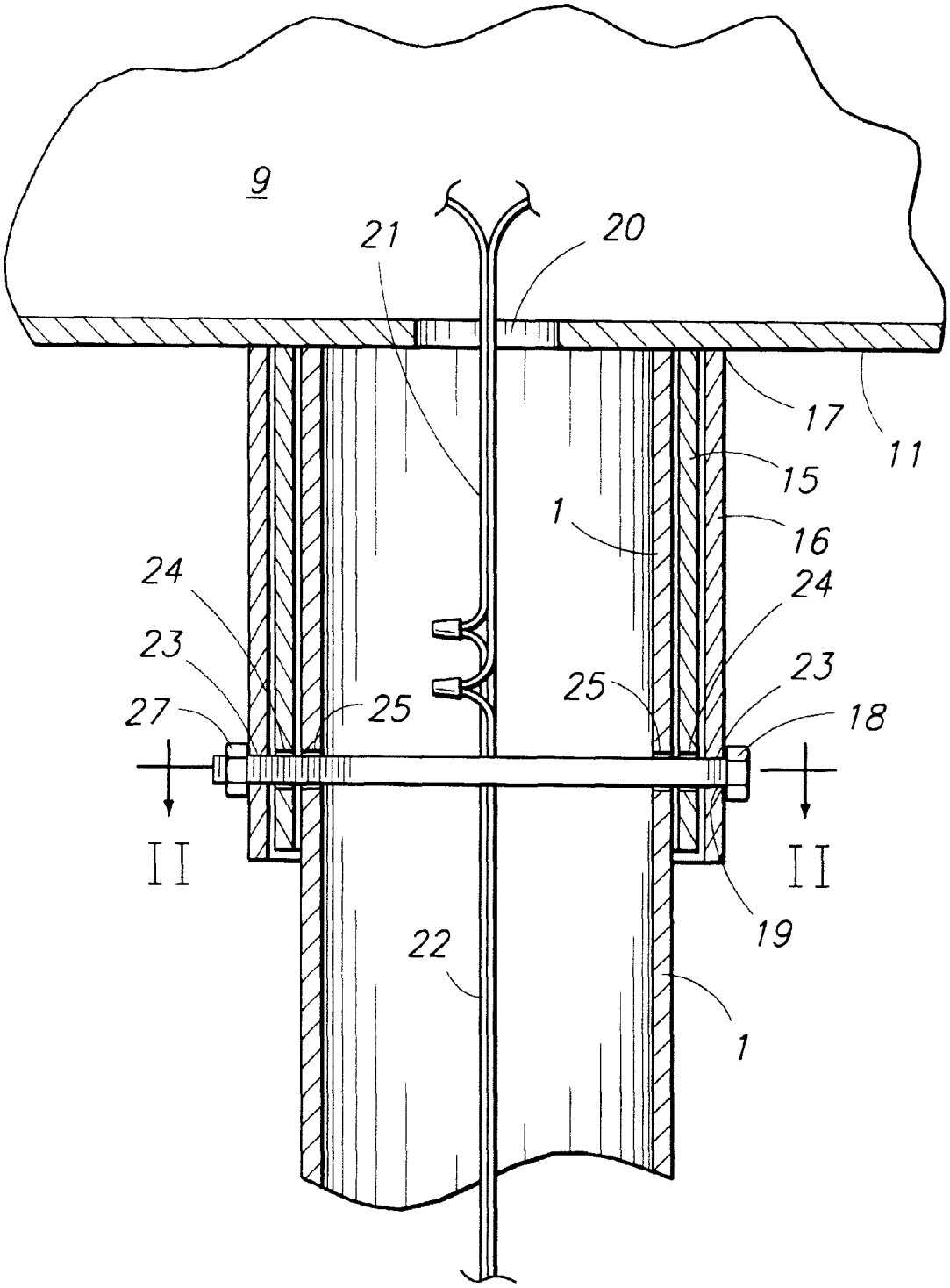
FIG. 9 is a side view, in axial cross-section taken at lines I—I, of the pole mounting sleeve assembly of FIG. 8, fitted to a pole of circular cross-section.
Figure 10:
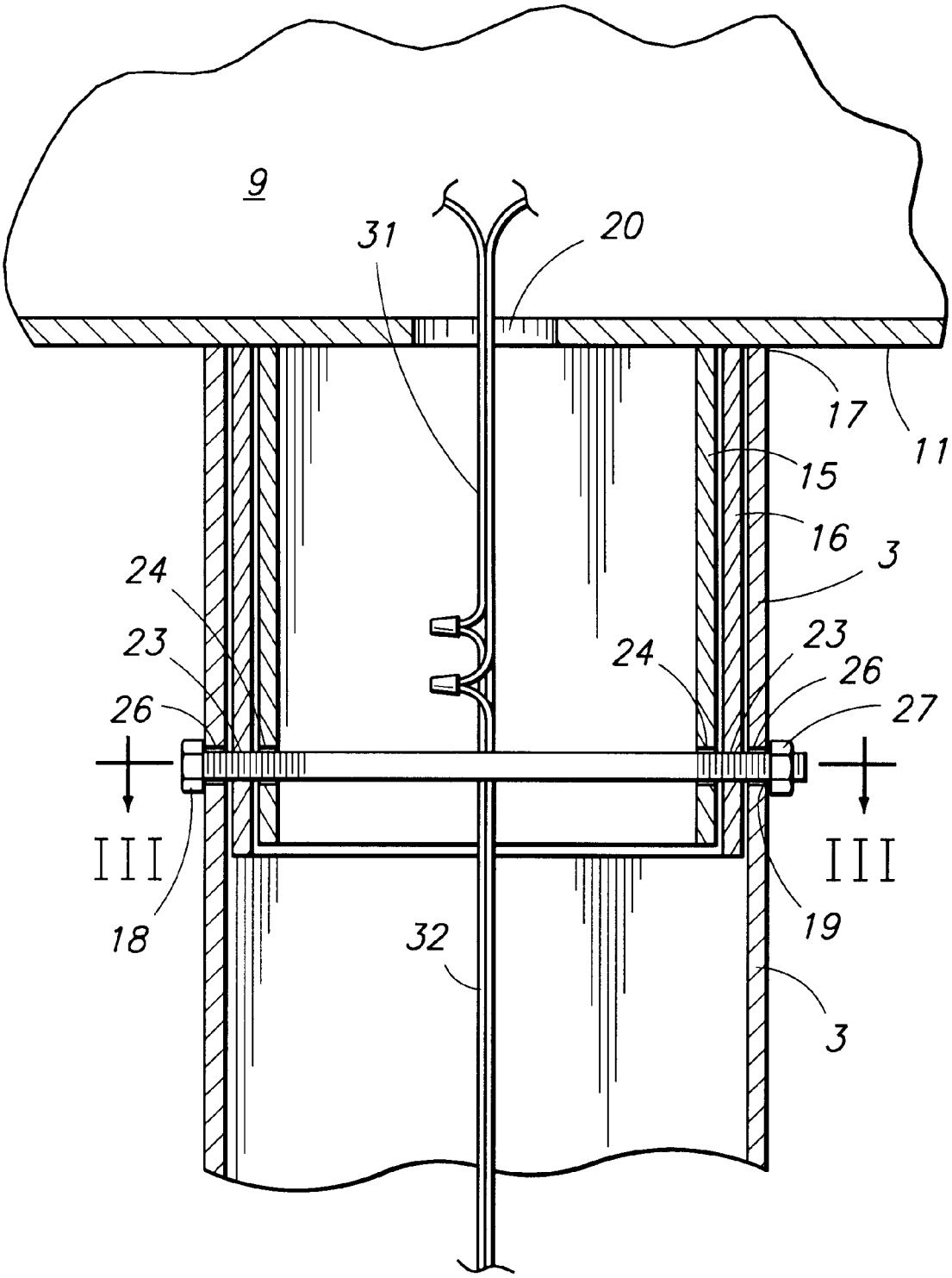
FIG. 10 is a side view, in axial cross-section taken at lines I—I, of the pole mounting sleeve assembly of FIG. 8, fitted to a pole of square cross-section.

In FIGS. 9 and 10, the multi-part mounting sleeve assembly 10 of FIG. 1 is further shown viewed from the side, in axial cross-section taken at lines I—I of FIG. 8. In FIG. 9, the a pole 1 of circular cross-section is fitted into the sleeve assembly 10, such that the end of the pole abuts against the bottom-facing side 11 of the bracket 9. A cylindrical pole 1 thus fits neatly within the cylindrical first part of the sleeve assembly 10. In this preferred embodiment, the pole 1 is of standard size, generally approximately two and three eights inches in outside diameter (2⅜" OD) or two and seven eights inches in outside diameter (2⅞" OD) in the United States.

In FIG. 10 the sleeve assembly 10 of FIG. 1 is again fitted to a pole 3 such that the end of the pole abuts against the bottom-facing side 11 of the bracket 9. However, in FIG. 10 pole 3 is of approximately square cross-section, and again of standard size, generally approximately four inches (4") or five inches (5") from side to side along one side in the United States. Thus, the second part 16 of the sleeve assembly 10 also fits neatly within a pole of generally square cross-section.

FIGS. 9 and 10 show the tubular first part 15 of the mounting sleeve 10, the tubular second part 16 of the mounting sleeve 10. FIGS. 9 and 10 also show more clearly holes 23 tapped in the second part 16 of the mounting sleeve, and holes 24 drilled through the first part 15 of the mounting sleeve. FIG. 9 also shows more clearly holes 25 drilled through cylindrical pole 1, and optional securing bolt 18 as it projects through all of the holes drilled or tapped in the mounting sleeve 10 and pole 9, while FIG. 10 shows more clearly holes 26 drilled through square pole 3. Both FIG. 9 and FIG. 10 show optional securing bolt 18 as it projects through all of the holes drilled or tapped in the mounting sleeve 10 and poles 1 and 3, and the line of attachment 17, by welding, of the first and second sleeve parts to the bottom-facing side 11 of the bracket 9. Each Figure also shows an access hole 20, through which wires 21 and 31 may be fed into the base of the bracket 9 to allow electrical connection between wires 22 and 32 found in poles 1 and 3 and wires from the accessories (not shown).

Figure 11:
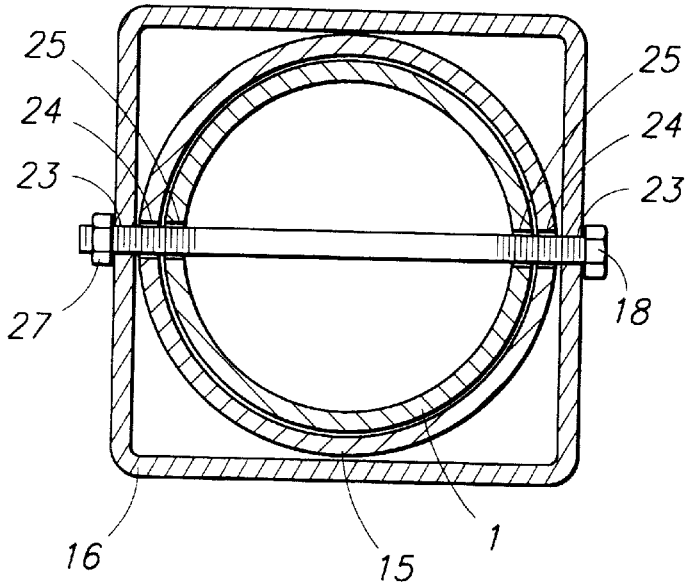
FIG. 11 is a bottom view of the pole mounting sleeve assembly of FIG. 9, in section along line II—II.
Figure 12:
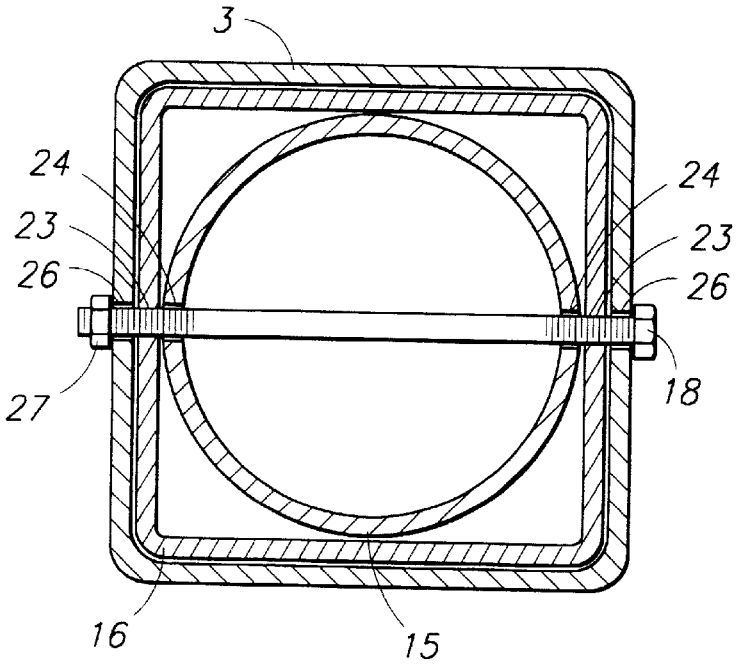
FIG. 12 is a bottom view of the pole mounting sleeve assembly of FIG. 10, in section along line III—III.
Figure 7B:
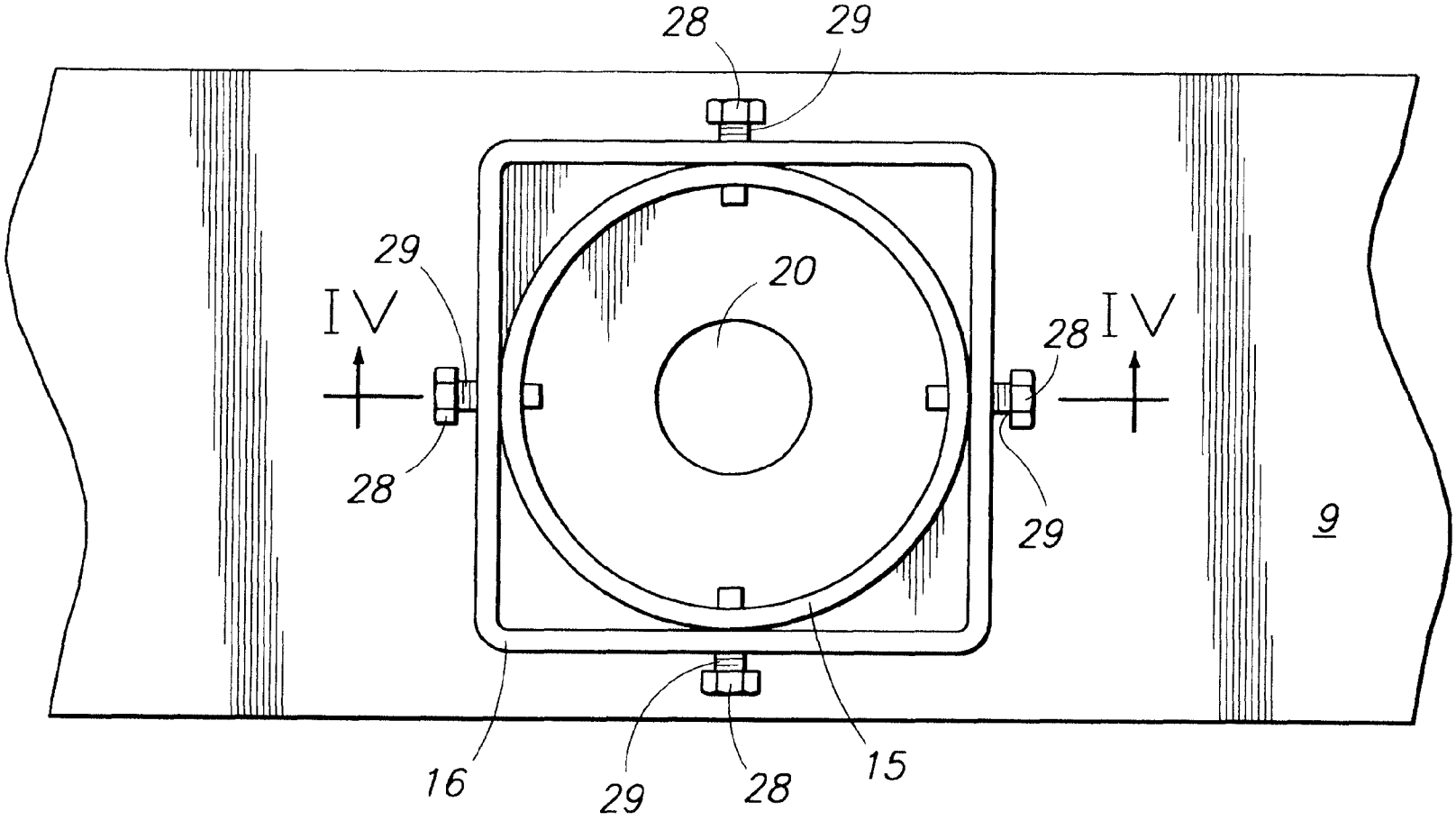

The benefits and flexibility of the present invention may be clearly seen when viewing FIG. 11, which is a sectional view along line II—II of FIG. 9, and when viewing FIG. 12, which is a sectional view along line III—III of FIG. 10. In FIG. 11 the mounting sleeve assembly 10 of FIG. 1 is again fitted to a cylindrical pole 1. The optional securing bolt 18 projects through holes 23 tapped in second sleeve part 16, and through holes 24 and 25 drilled through first sleeve part 15 and cylindrical pole 1 respectively.

In FIG. 12 the mounting sleeve assembly 10 of FIG. 1 is again fitted to a square pole 3. The optional securing bolt 18 projects through holes 23 tapped in second sleeve part 16, and through holes 24 and 26 drilled through first sleeve part 15 and square 3 respectively.

In use, the mounting sleeve assembly 10 is inserted over the standard size circular cross-sectional pole 1 or within the standard size square cross-sectional pole 3 after electrical connections are completed through bracket hole 20, and positioned with the pole abutting the bottom-facing side 11 of the mounting bracket 9. The circular pole 1 may be positioned against side 11 within the first part 15 of the mounting sleeve assembly 10, while the square pole 3 may be positioned against side 11 outside the second part 16 of the mounting sleeve assembly 10. Metal shims may be inserted, between the pole used and the part of the sleeve assembly against which the pole will bear, to take up excess play between pole and sleeve assembly. The mounting sleeve assembly may remain in position, whether the bracket 9 sits atop pole 1 or pole 3, by force of gravity. However, the optional securing bolt 18 may be inserted through the tapped and drilled holes in the sleeve assembly and the mounting poles, and the threads 8 of the bolt 18 engaged with the tapped threads of the second sleeve part 16. When the securing bolt 18 is tightened, or a nut 27 tightened onto the securing bolt, the mounting sleeve assembly 10, and so the entire mounting bracket 9 welded thereto, is securely fastened to either circular pole 1 or square pole 3.

DESCRIPTION OF A SECOND PREFERRED EMBODIMENT

The multi-part pole mounting sleeve assembly 10 constructed in accordance with the principles of the present invention may be secured to either cylindrical or square poles by a variety of methods. In addition to the single-bolt fastening method of the first preferred embodiment described above, a multiple-bolt method may be utilized to equally good advantage.

Referring to FIG. 13, for example, the placement and fastening of the mounting sleeve assembly 10 of FIG. 1 on the bottom-facing side 11 of the mounting bracket 9 is the same, and the mounting sleeve assembly 10 is again constructed of a cylindrical first sleeve part 15 set within a second sleeve part 16 which is approximately square in cross section. Again the mounting sleeve assembly has a set of holes tapped through the second part 16 of the sleeve assembly 10, and simply drilled through the first part 15 of the sleeve assembly 10. However, in the second embodiment of the sleeve assembly the holes need not all be oriented in a line to allow a single bolt 18 to travel through each part of the mounting sleeve assembly 10, and though the wall of a pole upon which the bracket 9 may be set. Instead, only those holes tapped or drilled on one side of the sleeve assembly must be aligned, to allow insertion of bolts or screws though the holes on one side of the mounting sleeve, and subsequent engagement with similar holes in a mounting pole.

Referring specifically to FIG. 13, the multi-part mounting sleeve assembly 10 of FIG. 1 is further shown on the bottom-facing side 11 of the center portion of the mounting bracket 9. In this embodiment, a plurality (in this example, four) of optional bolts 28 or set screws may be inserted through the second part 16 of the sleeve assembly 10 and the first part 15 of the sleeve assembly 10. The bolts 28 have threads 29 which engage the threads tapped into the second part 16 of the sleeve assembly 10. Again, a hole 20, through which wires may be passed for electrical connection, is drilled into the bottom-facing side 11 of the bracket 9 at a convenient location within the first part 15 of the sleeve.

Figure 14:
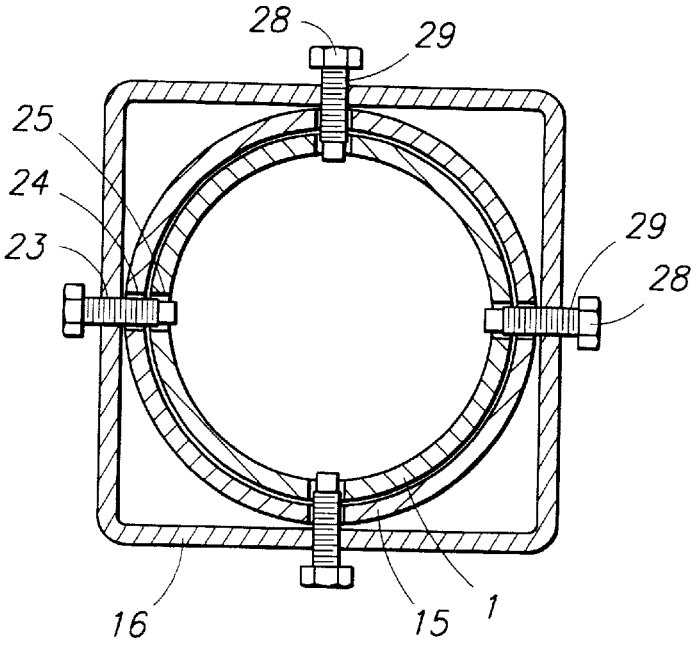
FIG. 14 is a bottom view, in cross-section at the mounting screws, of the pole mounting sleeve assembly of FIG. 13 mounted on a pole of circular cross-section.

The benefits and flexibility of the present invention may be clearly seen when viewing FIGS. 14 and 1 5, which are further sectional views through the mounting sleeve assembly in the same orientation as in FIGS. 11 and 12. In FIG. 14 the mounting sleeve assembly 10 of FIG. 1 is again fitted to a cylindrical pole 1. However, the optional securing bolts or screws 28 project through holes 23 tapped in second sleeve part 16, and through holes 24 and 25 drilled through first sleeve part 15 and cylindrical pole 1 respectively.

Figure 15:
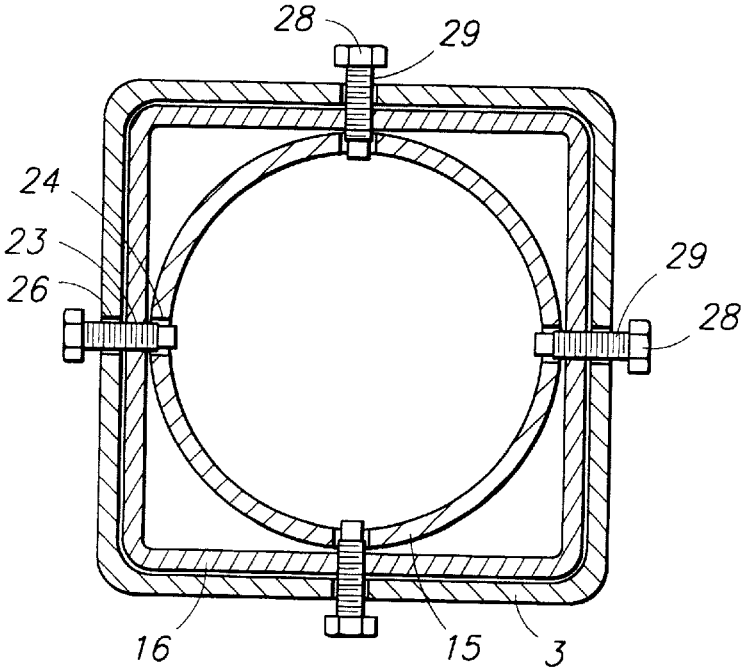
FIG. 15 is a bottom view, in cross-section at the mounting screws, of the pole mounting sleeve assembly of FIG. 13 mounted on a pole of square cross-section.

Likewise, in FIG. 15 the mounting sleeve assembly 10 of FIG. 1 is fitted to a square pole 3. The optional securing bolts or screws 28 project through holes 23 tapped in second sleeve part 16, and through holes 24 and 26 drilled through first sleeve part 15 and square pole 3 respectively.

Figure 16:
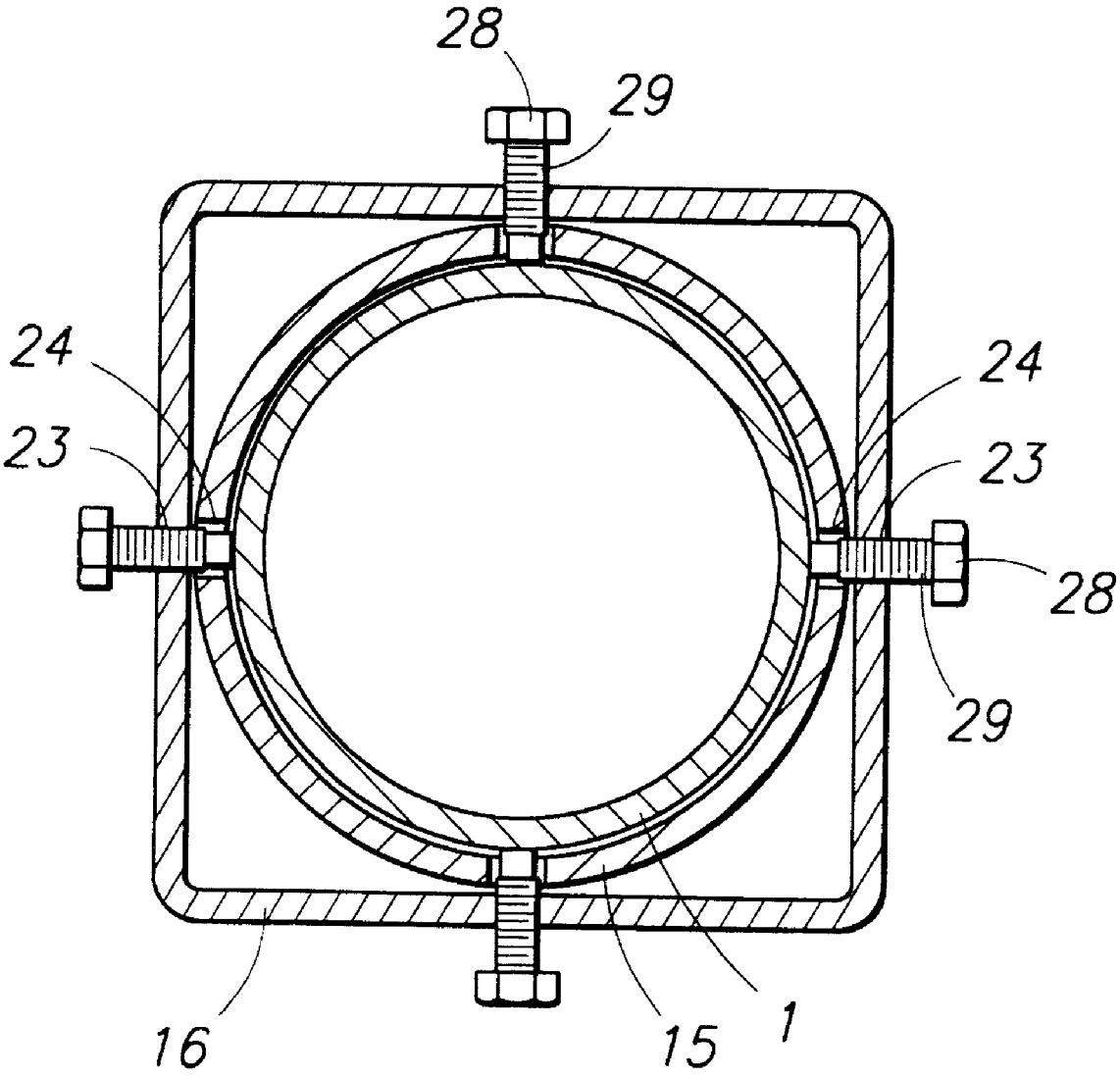
FIG. 16 is a bottom view, in cross-section at the mounting screws, of the pole mounting sleeve assembly of FIG. 13 mounted on a pole of circular cross-section, in which no holes are available in the pole for insertion of the mounting screws.

Finally, in FIG. 16 the mounting sleeve assembly 10 of FIG. 1 is again fitted to a cylindrical pole 1. The optional securing bolts or screws 28 project through holes 23 tapped in second sleeve part 16, and through holes 24 drilled through first sleeve part 15. However, cylindrical pole 1 in this figure has no holes available through which the screws 28 may project. In such cases, the pole mounting sleeve assembly may still be used to secure a bracket to the pole, as the screws 28 are tightened against pole 1 after threading through holes 23, thereby securing the mounting sleeve assembly to the pole. If the user is instead, or thereafter, faced with a pole of square cross section, such as that found in FIG. 15, rather than the cylindrical pole of FIG. 16, the user may remove screws 28 from their position in holes 23 and 24, and against cylindrical pole 1 as shown in FIG. 16. The user may then reinsert the same screws 28 through the same holes 23 and 24, after passing screws 28 through holes 26 in square pole 3 as shown in FIG. 15. The user may thereby secure the mounting sleeve assembly to poles of either square or cylindrical cross section using only the hardware of the present invention.

In use, the mounting sleeve assembly 10 of FIG. 1 is inserted over the standard size circular cross-sectional pole 1 or within the standard size square cross-sectional pole 3 after electrical connections are completed through bracket hole 20, and positioned with the pole abutting or near the bottom-facing side 11 of the mounting bracket 9. The circular pole 1 may be positioned against side 11 and within the first part 15 of the mounting sleeve assembly 10, or the square pole 3 may be positioned against side 11 and outside the second part 16 of the mounting sleeve assembly 10. Metal shims may be inserted between the pole used and the part of the sleeve assembly against which the pole will bear, to take up excess play between pole and sleeve. The mounting sleeve assembly may remain in position, whether the bracket 9 sits atop pole 1 or pole 3, by force of gravity. However, the optional securing bolts or screws 28 may be inserted through the tapped and drilled holes in the sleeve assembly 10 and the mounting poles, and the threads 29 of the bolts 28 engaged with the tapped threads of the second sleeve part 16. Upon tightening the bolts against the sleeve or pole, the mounting sleeve assembly 10, and so the entire mounting bracket 9 welded thereto, is securely fastened to either circular pole 1 or square pole 3.

What is claimed is:

1. A pole mounting bracket comprising:

a mounting bracket base, having a main body and a plurality of accessory mounting extensions on a first surface of the mounting bracket base, a mounting sleeve assembly attached at its end to a second surface of the mounting bracket base, the mounting sleeve assembly comprising a mounting sleeve first part and a mounting sleeve second part, the mounting sleeve first part comprising a first tubular section, the mounting sleeve first part having approximately circular cross-section, the mounting sleeve second part comprising a second tubular section, the mounting sleeve second part having approximately square cross-section, the mounting sleeve first part residing within the mounting sleeve second part, and the mounting sleeve first part and the mounting sleeve second part being approximately equal in length.

2. The mounting bracket of claim 1, wherein the mounting sleeve first and second parts are composed of metal.

3. The mounting bracket of claim 2 wherein the mounting sleeve first part has a first hole formed therein, and the mounting sleeve second part has a second hole formed therein, and the first hole and the second hole are formed to be substantially in alignment.

4. The mounting bracket of claim 3, wherein the hole of the mounting sleeve second part is tapped to create threads.

5. The mounting bracket of claim 2, further comprising means for fastening the mounting sleeve first and second parts together.

6. The mounting bracket of claim 5, wherein the mounting sleeve first part has a first hole formed therein, and the mounting sleeve second part has a second hole formed therein, and the first hole and the second hole are formed to be substantially in alignment.

7. The mounting bracket of claim 6, wherein the hole of the mounting sleeve second part is tapped to create threads.

8. A pole mounting bracket comprising:

a mounting bracket base, having a main body and a plurality of accessory mounting extensions on a first surface of the mounting bracket base, a mounting sleeve assembly comprising a mounting sleeve first part and a mounting sleeve second part, the mounting sleeve first part and the mounting sleeve second part being approximately equal in length, the mounting sleeve first part comprising a first tubular section, of approximately circular cross-section, the mounting sleeve first part attached at its end to a second surface of the mounting bracket base, the mounting sleeve second part comprising a second tubular section, of approximately square cross-section, the mounting sleeve second part attached at its end to a second surface of the mounting bracket base, and the mounting sleeve first part residing within the mounting sleeve second part.

9. The mounting bracket of claim 8, wherein the mounting sleeve first and second parts are composed of metal.

10. The mounting bracket of claim 9, wherein the mounting sleeve first part has a first hole formed therein, and the mounting sleeve second part has a second hole formed therein, and the first hole and the second hole are formed to be substantially in alignment.

11. The mounting bracket of claim 10, wherein the hole of the mounting sleeve second part is tapped to create threads.

12. The mounting bracket of claim 9, further comprising means for fastening the mounting sleeve first and second parts together.

13. The mounting bracket of claim 12, wherein the mounting sleeve first part has a first hole formed therein, and the mounting sleeve second part has a second hole formed therein, and the first hole and the second hole are formed to be substantially in alignment.

14. The mounting bracket of claim 13, wherein the hole of the mounting sleeve second part is tapped to create threads.

* * * * *